United States Patent [19]

Raymond

[11] Patent Number: 4,648,248

[45] Date of Patent: Mar. 10, 1987

[54] PRECIOUS STONE SETTING

[76] Inventor: Yves Raymond, 8755 Albanel Street, Saint-Léonard, Canada, H1P 2X9

[21] Appl. No.: 756,683

[22] Filed: Jul. 19, 1985

[51] Int. Cl.[4] ..... A44C 17/02

[52] U.S. Cl. ..... 63/28; 29/10

[58] Field of Search ..... 63/26, 27, 28; 29/10, 29/160.6

[56] References Cited

U.S. PATENT DOCUMENTS

| | | | |
|---|---|---|---|
| 755,654 | 3/1904 | Guild | 63/28 |
| 980,060 | 12/1910 | Buser | 63/26 |
| 1,328,948 | 1/1920 | Dover | 63/28 |
| 1,620,846 | 3/1927 | Wells | 29/160 |
| 2,094,529 | 9/1937 | Fisher | 63/28 X |
| 2,610,385 | 9/1952 | Manne | 29/10 |

*Primary Examiner*—Richard J. Johnson

[57] ABSTRACT

A setting for precious stones. The setting is an inverted angle member having a top lengthwise ridge. The two flanges of the angle member are cross-sectionally straight and make a 90° angle. Each stone is secured in a closely-shaped cavity by a pair of tabs, one at either end of the cavity. Each tab rigidly overlies the crown portion of the stone adjacent one end of the cavity. The cavity is made through the ridge and extends equally through each flange. The tabs are integral with the ridge. An important part of the downwardly tapered lower portion of the stone is visible at the outside faces of the flanges.

3 Claims, 6 Drawing Figures

PRECIOUS STONE SETTING

FIELD OF THE INVENTION

The present invention relates generally to settings for gems and precious stones, more specifically to a novel simplified setting which lends itself to a variety of forms.

BACKGROUND OF THE INVENTION

Heretofore in jewelry-making, precious stones, such as diamonds, emeralds, rubies, sapphires, etc., have been mounted on a base or setting by means of claws projecting inwardly over the contour edge of the cut stone. Such setting claws require very delicate workmanship and the form which an article of jewelry may take is sometimes limited by the setting used as well as by the number of claws needed. Also in known settings, the lower portion of the stone is not exposed to light and its brilliance does not therefore attain its maximum potential.

OBJECTS OF THE INVENTION

It is an important object of the present invention to provide a setting for precious stones, which is very simple in design and which can be made in a wide variety of forms.

It is an equally-important object of the present invention to provide a setting of the above type, which obviates the use of claws to secure a precious stone therein and which allows light to reach the lower portion of the stone.

SUMMARY OF THE INVENTION

The above and other objects and advantages of the present invention are realized according to a preferred embodiment comprising a setting, the basic embodiment of which is an angle member, preferably of a precious metal, of indeterminate length. The member is inverted to stand on its two flanges and forms a lengthwise ridge. The flanges are cross-sectionally straight. The included angle between the two flanges is preferably ninety degrees.

The angle member is formed with at least one cavity. The cavity extends through the ridge downwardly equally through the two flanges and conforms in shape to the shape of the lower portion of a cut stone. An essential feature of the cavity is that its upper part, i.e. adjacent the ridge, is vertically countersunk through the ridge a short distance.

The cut stone is of the type having a contour edge defining a diameter which is slightly less than the length of the countersunk portion of the cavity. This contour edge divides the stone between its crown and its lower portion. The crown is typically characterized by a plurality of upwardly-inwardly-inclined facets and the lower portion has downwardly converging facets.

The contour edge of the stone or gem to be set is adapted to rest on the lower portion of the countersunk part of the cavity at each end of the latter and tabs integral with the ridge at each end of the cavity overlie. An adjacent facet of the crown to secure the stone in the cavity. The edge of the cavity forms a seat for the stone and the lower portion of the stone is partly exposed at the outer face of the flanges.

BRIEF DESCRIPTION OF THE DRAWINGS

The above will be clearly understood by having referral to the preferred embodiments of the invention, illustrated by way of the accompanying drawings, in which.

Like numerals indicate like elements throughout the drawings.

DETAILED DESCRIPTION OF THE PREFERRED EMBODIMENTS

Figure 1:
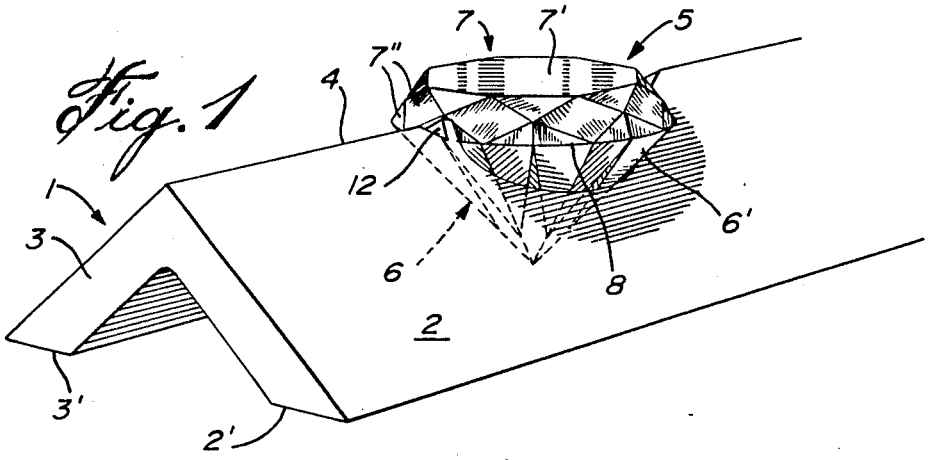
FIG. 1 is a perspective view of the basic setting member including a precious stone set therein.

According to the invention, there is provided a setting member 1, of inverted angle shape, preferably of a precious metal, and having cross-sectionally straight flanges 2, 3. The lower ends of leg flanges 2 and 3 are made transversely flat at 2' and 3'.

Member 1 has an upper lengthwise apex or ridge 4 and the included angle between flanges 2 and 3 is ninety degrees, as shown.

Referring now to FIGS. 2-5, there is shown how a precious stone or gem 5 is mounted in setting member 1.

Precious stone 5 may be cut in any conventional shape, such as the rose cut, shown in the drawings. Stone 5, for descriptive purposes, has a lower portion 6 and an upper portion or crown 7. The lower portion 6 is generally of an inverted cone in shape and is cut with a plurality of facets 6'. The crown 7 has a flat top 7' and a plurality of upwardly-inwardly-inclined facets 7''. The crown 7 and lower portion 6 are separated by a contour edge 8 which defines the maximum diameter of stone 5.

Precious stone 5 is mountable in a cavity 9 formed in setting member 1. The cavity 9 is shaped precisely to closely support the lower portion 6 of stone 5, it being understood that the general shape of cavity 9 may vary according to how each individual stone is cut. The cavity 9 depicted is generally oval in the lengthwise direction and when seen from the top, as in FIG. 5. Cavity 9 is also concave from end to end to advantageously reveal the upper part of lower portion 6 of the stone (FIG. 3) and, as seen in FIG. 4, flanges 2, 3 are cut away orthogonally at 9' to form a seat to support the same lower portion 6.

Figure 2:
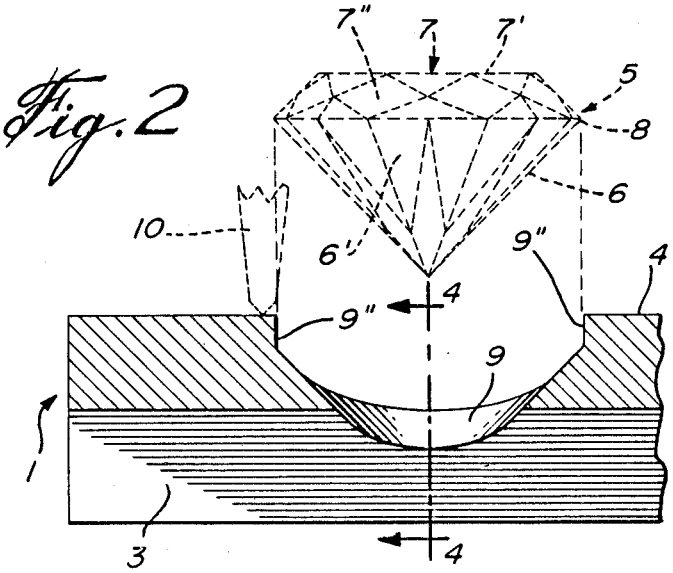
FIG. 2 is a longitudinal section taken along line 2—2 of FIG. 4, also showing in dashed outline a graver and precious stone.

FIG. 2 clearly shows at 9'' the vertically-countersunk portion mentioned in the summary. The cavity 9 is made deep enough to ensure that contour edge 8 of stone 5 is located at the bottom of countersunk portion 9'' so that ridge 4 is at a higher level than contour edge 8. The length of cavity 9 is only slightly longer than the diameter of contour edge 8.

FIG. 2 further shows how a stone 5 is secured in cavity 9: a jeweller's graver or burin 10 is used to make a generally rhombus-shaped notch 11 in ridge 4 at both ends of cavity 9 after stone 5 is placed in the latter. The rigid but deformable metal of member 1 is thus worked by the graver 10 to make a tab 12, which rigidly overlies and secures the adjacent facet 7'' of the crown of stone 5.

Figure 3:
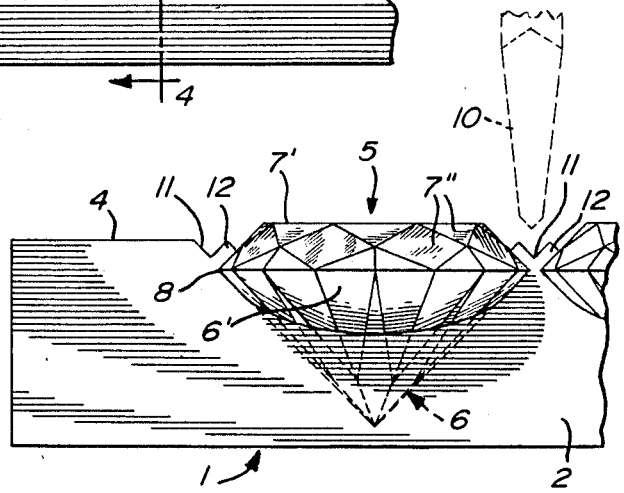
FIG. 3 is a side elevation of a portion of the basic setting member showing how two proximate precious stones may be set.
Figure 4:
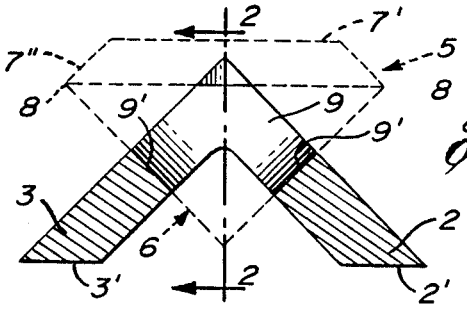
FIG. 4 is a cross-sectional view taken along line 4—4 of FIG. 2, also showing in dashed outline a precious stone set in the cavity.
Figure 5:
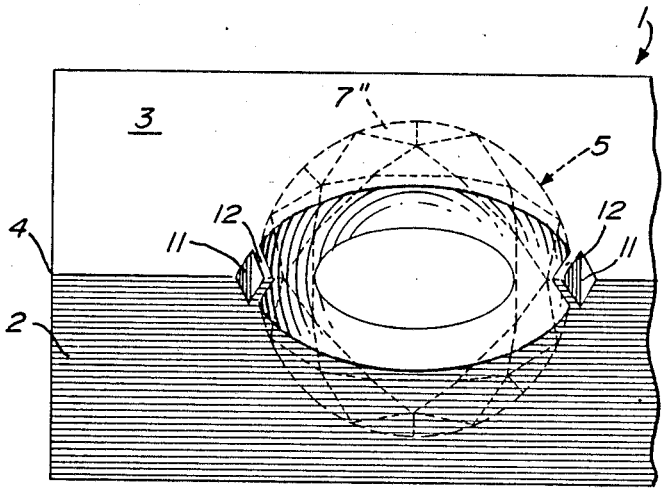
FIG. 5 is a top plan view of the member of FIG. 1 showing a precious stone in dashed outline and two tabs at either end of the cavity.

FIG. 3 illustrates the possibility of setting two adjacent stones 5 with the same notch 11.

Figure 6:
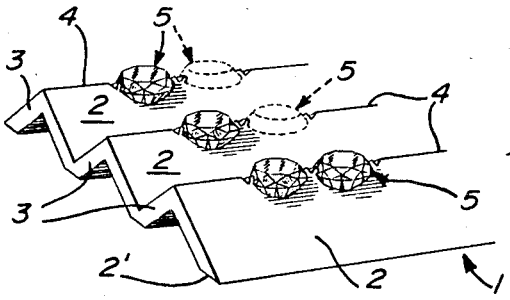
FIG. 6 is a perspective view of one possible setting design using the basic setting member.

Referring finally to FIG. 6, there is illustrated a modified embodiment of setting member 1, consisting of a plurality of inverted angle members 1 disposed side by side and secured lengthwise at the lower ends of adjacent flanges 2 and 3. It is to be understood that setting members 1 may be combined into rectangles, triangles, circles, spirals fan shapes, rings, etc., without departing from the spirit or scope of the invention.

What I claim is:

1. A precious cut stone in combination with a setting therefor, said cut stone having a shape of the type defining a contour edge, a crown upwardly projecting from said contour edge and defining upwardly converging first facets and a lower portion downwardly projecting from said contour edge and defining downwardly converging second facets, said setting comprising an angle member made of rigid but deformable material, said angle member consisting of two cross-sectionally straight flanges meeting at an uppermost lengthwise ridge and diverging from said ridge at a generally 90° angle, said angle member being formed with a cavity to support said precious stone, said cavity extending through said ridge and downwardly equally through said flanges on each side of said ridge, the edge of said cavity forming a seat for said lower portion of said stone, said seat having opposite portions extending across said ridge which are downwardly countersunk a distance sufficient for said ridge to be at a higher level than said contour edge when said stone is supported on said seat and a tab integral with said ridge at both said opposite seat portions of said cavity and overlying an adjacent said first facet, thereby securely retaining said stone in said cavity with portions of said second facets exposed at the outer faces of said flanges.

2. The combination of claim 1, wherein said angle member has a plurality of cavities spacedly located along said ridge and a stone set in each cavity.

3. The combination of claim 2, wherein there is at least one additional angle member disposed side by side with said first-named angle member and connected therewith along the outer edges of the adjacent flanges, said additional angle member having a plurality of said cavities spacedly located along its ridge and additional stones set in each cavity of said additional angle member.

* * * * *